US007699658B2

(12) United States Patent
Gaidosch et al.

(10) Patent No.: US 7,699,658 B2
(45) Date of Patent: Apr. 20, 2010

(54) CONNECTION ADAPTER FOR SENSORS OR ACTUATORS

(75) Inventors: Othmar Gaidosch, Ostfildern (DE); Uwe Widmann, Baltmannsweiler (DE)

(73) Assignee: Hirschmann Automation and Control, Neckartenzlingen ( * ) Notice: Subject to any disclaimer, the term of this patent is extended or adjusted under 35 U.S.C. 154(b) by 0 days.

(21) Appl. No.: 12/160,239

(22) PCT Filed: Jan. 8, 2007

(86) PCT No.: PCT/EP2007/000088

§ 371 (c)(1),
(2), (4) Date: Jul. 8, 2008

(87) PCT Pub. No.: WO2007/082647

PCT Pub. Date: Jul. 26, 2007

(65) Prior Publication Data

US 2009/0011630 A1 Jan. 8, 2009

(30) Foreign Application Priority Data

Jan. 11, 2006 (DE) ..... 10 2006 001 629

(51) Int. Cl.
*H01R 31/06* (2006.01)

(52) U.S. Cl. ..... 439/628; 439/76.1; 439/638

(58) Field of Classification Search ..... 439/638, 439/628, 76.1

See application file for complete search history.

(56) References Cited

U.S. PATENT DOCUMENTS

| | | | | |
|---|---|---|---|---|
| 5,302,138 | A | 4/1994 | Shields | 439/527 |
| 6,389,903 | B1 * | 5/2002 | Oba et al. | 439/628 |
| 6,634,910 | B2 | 10/2003 | Lieb | 439/715 |

* cited by examiner

*Primary Examiner*—Briggitte R Hammond
(74) *Attorney, Agent, or Firm*—Andrew Wilford

(57) ABSTRACT

A connection adapter is configured and shaped to be connected between the connection side of a sensor or of an actuator and the input side of a plug connector in order to adapt different plug faces of the sensor or actuator and of the plug connector to each other. The connection adapter has a plug base facing toward the plug connector and with contact chambers and comprises a fastening area facing toward the sensor or actuator.

6 Claims, 3 Drawing Sheets

CONNECTION ADAPTER FOR SENSORS OR ACTUATORS

TECHNICAL FIELD

The invention relates to a connection adapter for sensors or actuators according to the introductory clause of patent claim 1.

STATE OF THE ART

It is known that sensors or actuators comprise contacts that form a plug face of predetermined configuration for current supply and/or signal transfer on the output side (in sensors) or on the input side (in actuators). Electrical current or signals is/are transmitted via these contacts. A corresponding plug connector with a plug face corresponding to the plug face of the sensor or of the actuator is fitted to the plug face of the sensor or of the actuator. However, a great number of parts is required for such connection, depending on the requirements on the plug faces of the sensors, the actuators and of the plug connectors since every time the plug face of the sensor or of the actuator changes, the plug face of the plug connector must also be adapted.

OBJECT OF THE INVENTION

The object of the invention is therefore to eliminate the above-described disadvantages and make it possible that, when changes are made to the sensor, the actuator or the plug connector fitted to them, the entire sensor or actuator does not always have to be changed.

This object is attained by patent claim 1.

According to the invention a connection adapter is connected between a sensor, actuator, or plug connector and is configured and shaped for connection between the connection side of the sensor or of the actuator and between the input side of the plug connector in order to adapt different plug faces of the sensor or of the actuator and of the plug connector to each other.

The connection adapter is therefore an electromechanical interface between the sensor (or actuator) and a plug connector (also called plug, coupling, jack or the like) or another coupling to an electromechanical functional unit. Thus, the connection adapter that is connected to the sensor or the actuator in a mechanically and electrically fixed and tight manner forms the externally complimentary counterpart to a predefined plug connection, so that it must have a shape and function corresponding to it. Connection adapters are also conceivable that have no external plug connection function but rather comprise a permanently molded-on electrical line. The substantial advantage of such a connection adapter is that given a uniformly shaped interface between sensor and/or actuator and the connection adapter the corresponding sensors and/or actuators can be mounted in a modular manner and can thus be provided very economically with a plurality of electromechanical interfaces. This means that the connection adapter makes it possible to always provide one and the same plug face, e.g. on the side facing toward the plug connector whereas the plug face of the connection adapter can be different on the side facing toward the sensor or of the actuator. The opposite can be done, in which case the same plug face is always formed on the sensor and/or actuator and the connection adapter while the plug face of the connection adapter can have a plurality of possibilities on the side facing the plug face of the plug connector.

Economy in the production of sensors, actuators and plug connectors can be achieved by the connection adapter since their plug faces can always have the desired shape, especially as a function of client wishes, whereas it becomes possible with adapters that are differently configured with respect to their electrical function as well as their mechanical and physical configuration to adapt these so to say standard designs of the sensors, actuators and plug connectors to each other.

Further embodiments from which corresponding advantages result are indicated in the dependent claims.

BRIEF DESCRIPTION OF THE DRAWINGS

An exemplary but non-limiting embodiment of a connection adapter in accordance with the invention is described in the following and is explained using FIGS. 1 to 4.

WAYS OF CARRYING OUT THE INVENTION

Figure 1:
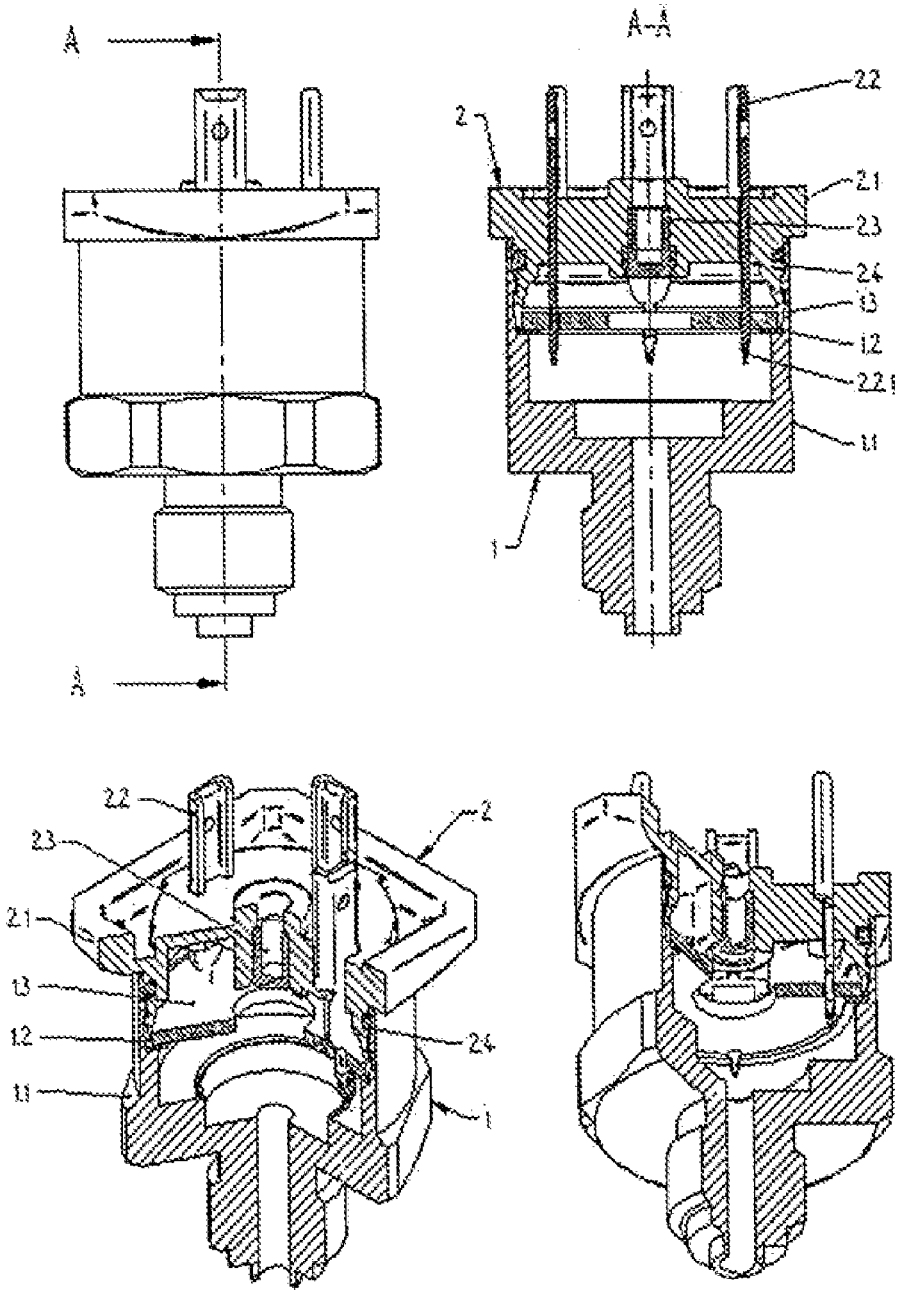

FIGS. 1 to 4, especially FIG. 1, show, in as far as is shown in detail, a complete sensor housing 1 with an already mounted connection adapter 2 in accordance with the invention. A seat 1.2 for a printed-circuit board 1.3 is provided in a sensor housing 1.1. The connection adapter 2 comprises a plug base 2.1 facing toward the plug connector and also comprises outwardly directed contacts 2.2. The sensor housing (FIG. 2) comprises a press-in jacket surface 1.1.1 for the printed-circuit board 1.3 and its mechanical fastening as well as electrical contacting. 1.1.2 designates a support surface for the printed-circuit board 1.3 and for its mechanical fastening whereas 1.1.3 is a sealing surface for sealing the connection adapter 2. Furthermore, a rotation-blocking formation 1.1.4 is present that prevents a relative rotational movement between the connection adapter 2 and the sensor or the actuator and/or their housings. Another rotation-blocking formation 1.1.3 is also provided that for its part prevents a relative rotational movement between the printed-circuit board 1.3 and its mechanical fastening and the sensor or the actuator and/or their housings.

Finally, the sensor housing 1.1 has an axial stop surface 1.1.6 as well as an axial stop and fastening surface 1.1.7.

Figure 2:
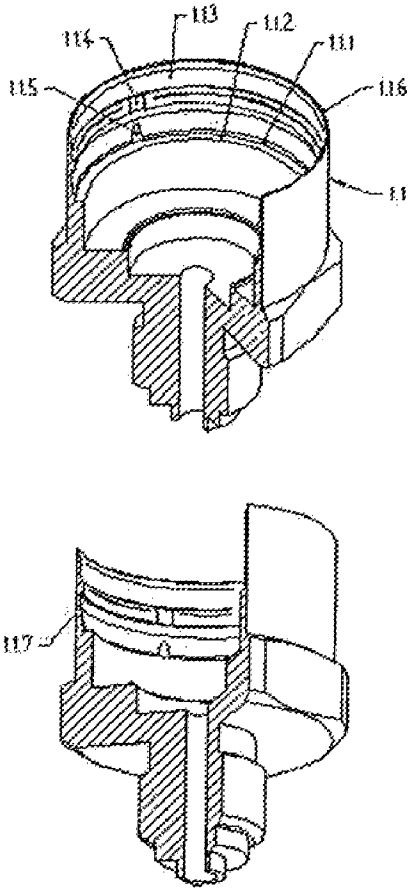
Figure 3:
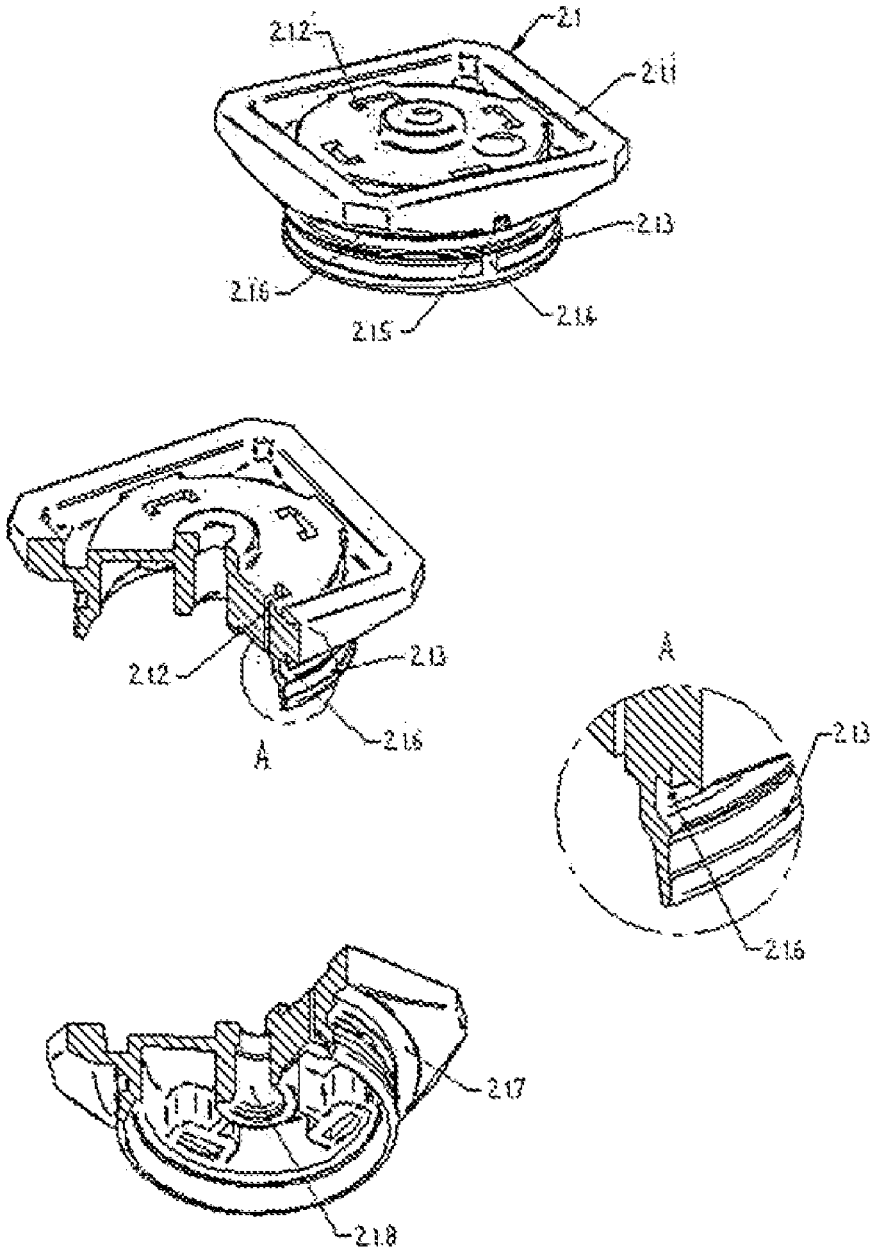

The previously cited embodiments of the sensor housing 1.1 shown in FIG. 2 correspond to embodiments of the plug base 2.1 of the connection adapter 2 as shown in FIG. 3 and described in the following. The plug base 2.1 has a sealing surface 2.1.1 for a corresponding plug connection (not shown here). Furthermore, at least one, preferably several contact chambers 2.1.2 for receiving and fastening respective contacts 2.2 are provided. Alternatively, the contacts 2.2 can also be molded in place. If no contact projects out of the at least one contact chamber 2.1.2, this contact chamber can either be closed or a cable, in particular a connection cable to an electronic apparatus connected in downstream, can extend out of it.

Furthermore, the plug base 2.1 comprises an axial stop and/or fastening surface corresponding to the axial stop surface 1.1.7. Furthermore, a rotation-blocking formation 2.1.4 is present on the plug base 2.1 corresponding to the rotation-blocking formation 1.1.4. In order to be able to ensure an angularly correct mounting between connection adapter 2 and sensor housing 1.1 (or the actuator housing) a coding 2.1.5 is provided. The plug base 2.1 has a sealing surface 2.1.6 for the already designated seal 2.4, preferably designed as a sealing ring or O-ring. Finally, an axial stop surface 2.1.7 is also present on the sensor housing 1.1 corresponding to the axial stop surface 1.1.6, as well as a receiving bore 2.1.8 specific to the design and for a press-in nut 2.3 by means of which connection adapter 2 can be screwed to the counterplug or optionally to the sensor or the actuator. Alternatively, the press-in nut 2.3 can also be molded in place.

Figure 4:
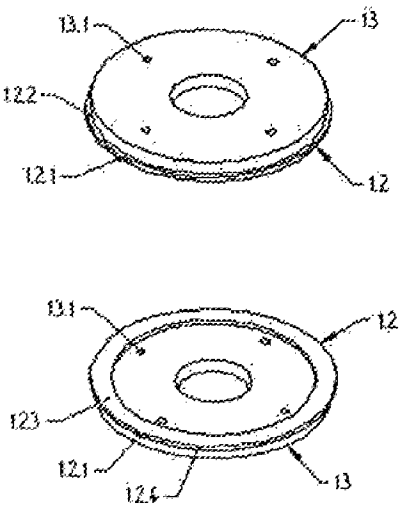

FIG. 4 shows the seat 1.2 for the printed-circuit board 1.3, which is an electrically conductive, preferably metallic part with a circular, polygonal (especially rectangular or square) shape or some other round shape that has the property that the outer periphery defined by this shape is a tight fit in the press-in jacket surface 1.1.1. This part is connected electrically and mechanically positioned by soldering, pressing in or the like via highly bent press-in pins, via additional parts or the like to the printed-circuit board 1.3 to a fixed structural group.

Alternatively, one can think about adhesively mounting the printed-circuit board 1.3 to its seat 1.2.

Reference numeral 1.2.1 designates an (optional) rotation-blocking formation complementary to the rotation-blocking formation 1.1.5. A mounting surface 1.2.2 serves to press the structural group into the sensor housing 1.1 up to the support surface 1.1.2.

For the purpose of a positionally correct insertion and fastening yet another support surface 1.2.3, corresponding to the support surface 1.1.2, and a press-in surface 1.2.4 corresponding to the jacket surface 1.1.1 are present.

The printed-circuit board 1.3 has metallized bores 1.3.1 for the electrical connection of contacts 2.2 and the associated contact of a plug connection.

It is therefore clear and unmistakable from the above comments and by viewing FIGS. 1-4 that the connection adapter 2 (FIG. 3) makes it possible to adapt the plug face of the sensor that is provided in the sensor housing 1.1 (FIG. 2) to the output-side plug face and therewith to the plug face of the outer plug connector. It is possible to adapt the plug faces facing each other to each other via the printed-circuit board 1.3 and in particular its completely metallized bores 1.3.1. The latching and/or pressed-in connection of the seat 1.2 for the printed-circuit board 1.3 in the connection adapter 2 and its pressed-in or resting connection with sensor housing 1.1 (or the housing of an actuator) have the advantage of a rapid and economical mounting that can be made possible in particular without further tools.

On the whole, the connection adapter in accordance with the invention thus offers a plurality of possibilities for adapting the different plug faces of a sensor or of an actuator to the always identical plug face of a plug connection, or, inversely, for adapting one and the same plug face of a sensor or an actuator to the different plug faces of a plug connection.

Moreover, it is possible with the connection adapter that no plug connection is connected to it but rather that the connection adapter is connected to the end of a cable in order to connect the sensor or actuator to an apparatus connected downstream in this manner in order, e.g. to supply the parameters that are recorded with a passively acting sensor to the apparatus connected downstream or also to make possible a current supply in the case of an active sensor in addition to signal transmission.

The same also applies for actuators supplied via the connection adapter of the invention with current and/or control signals.

LIST OF REFERENCE NUMERALS

1. complete sensor housing
1.1 sensor housing
1.1.1 press-in jacket surface for receiver printed-circuit board 1.2 (mechanical fastening and electrical contacting)
1.1.2 support surface (for receiving printed-circuit board 1.2)
1.1.3 sealing surface (for sealing ring 2.4)
1.1.4 rotation-blocking formation (for plug base 2.1)
1.1.5 rotation-blocking formation (optional only since a press connection is provided between surfaces 1.1.1 and 1.2.4) for receiver printed-circuit board 1.2
1.1.6 axial stop surface (for plug base 2.1)
1.1.7 axial stop and/or fastening surface (for plug base 2.1)
1.2 receiver printed-circuit board
1.2.1 (optional) rotation-blocking formation (corresponding to 1.1.5)
1.2.2 mounting surface (for pressing in the structural group into sensor housing 1.1 up to support surface 1.1.2)
1.2.3 support surface (corresponding to support surface 1.1.2)
1.2.4 press-in surface (corresponding to jacket surface 1.1.1)
1.3 printed-circuit board
1.3.1 completely metallized printed-circuit board bore (for contact ends 2.2.1)
2 connection adapter
2.1 plug base
2.1.1 sealing surface for corresponding plug connection (specifically for the exemplary case here)
2.1.2 contact chamber (receiving and fastening contacts 2.2)
2.1.3 axial stop and/or fastening surface (corresponding to stop surface 1.1.7)
2.1.4 rotation-blocking formation (corresponding to 1.1.4)
2.1.5 coating for correct positioning
2.1.6 sealing surface (for sealing ring 2.4)
2.1.7 axial stop surface on sensor housing (corresponding to surface 1.1.6)
2.1.8 receiver bore (for press-in nut 2.3, specific for the exemplary case here)
2.2 contact
2.2.1 contact end on the printed-circuit board side (as press-in pin for completely metallized hole of printed-circuit board 1.3)
2.3 press-in nut (specifically for the exemplary design shown here, as a rule this part is eliminated)
2.4 sealing ring between connection adapter and sensor housing

The invention claimed is:

1. In combination with a sensor or actuator connector having an outwardly cylindrical collar centered on an axis and having an axially outwardly directed shoulder forming a seat, an adapter comprising:

a base formed with a cylindrical collar fitted complementarily inside the connector collar and formed with an axially inwardly directed shoulder confronting the connector shoulder;

a printed-circuit board axially clamped between the shoulders; and a plurality of axially extending contact prongs extending axially through the base, having inner ends seated in the printed-circuit board, and outer ends projecting axially from the base.

2. The combination defined in claim 1, further comprising a seal ring set in an outer surface of the base collar and radially outwardly engaging the connector collar.

3. The combination defined in claim 1 wherein the printed-circuit board and the base collar have complementary interfitting coding formations only permitting the board to fit in the base collar in one predetermined position.

4. The combination defined in claim 1 wherein the collars have complementary radially directed coding formations only permitting the collars to fit together in one predetermined angular position.

5. The combination defined in claim 1 wherein the base has an axially directed face bearing axially inward on end edge of the connector collar.

6. The combination defined in claim 1 wherein the base is provided with an axially centered and outwardly open press-in nut.

* * * * *

UNITED STATES PATENT AND TRADEMARK OFFICE

CERTIFICATE OF CORRECTION

PATENT NO. : 7,699,658 B2
APPLICATION NO. : 12/160239
DATED : April 20, 2010
INVENTOR(S) : Othmar Gaidosch et al.

It is certified that error appears in the above-identified patent and that said Letters Patent is hereby corrected as shown below:

Title Page
Item (73),
The name of the Assignee should be
-- HIRSCHMANN AUTOMATION AND CONTROL GMBH --

Item (73),
The Country of the Assignee
This line should be
-- Neckartenzlingen (DE) --

Signed and Sealed this

Twentieth Day of July, 2010

David J. Kappos

David J. Kappos
*Director of the United States Patent and Trademark Office*